US006860188B2

(12) United States Patent
Pitla et al.

(10) Patent No.: US 6,860,188 B2
(45) Date of Patent: Mar. 1, 2005

(54) VARIABLE DISPLACEMENT COMPRESSOR HINGE MECHANISM

(75) Inventors: Srinivas S. Pitla, Canton, MI (US); Vipen Khetarpal, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/600,140

(22) Filed: Jun. 20, 2003

(65) Prior Publication Data

US 2004/0255775 A1 Dec. 23, 2004

(51) Int. Cl.[7] ..... F01B 3/02
(52) U.S. Cl. ..... 92/12.2
(58) Field of Search ..... 92/12.2; 417/222.1, 417/222

(56) References Cited

U.S. PATENT DOCUMENTS 4,846,049 A 7/1989 Terauchi
5,002,466 A 3/1991 Inagaki et al.
5,752,413 A 5/1998 Kuhn et al.
5,826,490 A 10/1998 Madsen et al.
5,865,604 A 2/1999 Kawaguchi et al.
5,931,079 A 8/1999 Kazahaya
6,158,968 A * 12/2000 Nakamura ..... 417/222.1
6,470,761 B1 10/2002 Nakamura et al.
6,508,634 B2 1/2003 Ota et al.

FOREIGN PATENT DOCUMENTS

EP 1052404 A2 5/2000
EP 1275846 A2 6/2002

* cited by examiner

*Primary Examiner*—F. Daniel Lopez
(74) *Attorney, Agent, or Firm*—MacMillan, Sobanski & Todd LLC

(57) ABSTRACT

A hinge mechanism for a variable displacement swash plate type compressor including an arm extending from a rotor and a pair of arms extending from a swash plate hub, wherein a pair of shoes are interposed between the arm of the rotor and each of the arms of the swash plate hub to facilitate a tilting of a swash plate disposed on the swash plate hub, the hinge mechanism militating against undesirable contact between the arms of the swash plate hub and the arm of the rotor.

14 Claims, 7 Drawing Sheets

VARIABLE DISPLACEMENT COMPRESSOR HINGE MECHANISM

FIELD OF THE INVENTION

The present invention relates to a variable displacement swash plate type compressor adapted for use in an air conditioning system for a vehicle, and more particularly to a hinge mechanism for a variable displacement compressor including an arm extending from a rotor and a pair of arms extending from a swash plate hub, wherein one shoe of a pair is interposed between the arm of the rotor and each of the arms of the swash plate hub to facilitate the tilting of a swash plate disposed on the swash plate hub.

BACKGROUND OF THE INVENTION

Variable displacement swash plate type compressors typically include a cylinder block provided with a number of cylinders, a piston disposed in each of the cylinders of the cylinder block, a crankcase sealingly disposed on one end of the cylinder block, a rotatably supported drive shaft, and a swash plate. The swash plate is adapted to be rotated by a rotor disposed on the drive shaft. The swash plate and the rotor are typically connected by a hinge mechanism. The rotation of the swash plate is effective to reciprocatively drive the pistons. The length of the stroke of the pistons is varied by varying an inclination or tilting angle of the swash plate.

During operation, the elements of a hinge mechanism of a conventional compressor sometimes interfere with one another while the inclination of the swash plate is varied. The interference of elements causes undesirable forces to act on the hinge mechanism and works against a smooth operation of the compressor. The interference can also cause a binding of the hinge mechanism of the compressor.

It would be desirable to produce a hinge mechanism for a variable displacement swash plate type compressor which facilitates smooth operation of the compressor.

SUMMARY OF THE INVENTION

Consistent and consonant with the present invention, a hinge mechanism for a variable displacement swash plate type compressor which facilitates smooth operation of the compressor, has surprisingly been discovered.

The hinge mechanism for a variable displacement swash plate type compressor comprises: a rotor adapted to be mounted on and rotated by a drive shaft, the rotor having at least one arm extending outwardly therefrom; a hub adapted to be mounted on the drive shaft and to rotate with the rotor, the hub having at least one arm extending outwardly therefrom towards the rotor and adjacent the arm of the rotor; and at least one shoe disposed between the arm of the rotor and the arm of the hub, the shoe adapted to be seated in a pocket formed in at least one of the arm of the rotor and the arm of the hub, wherein the shoe facilitates a slanting of the hub and transfers rotation from the rotor to the hub.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
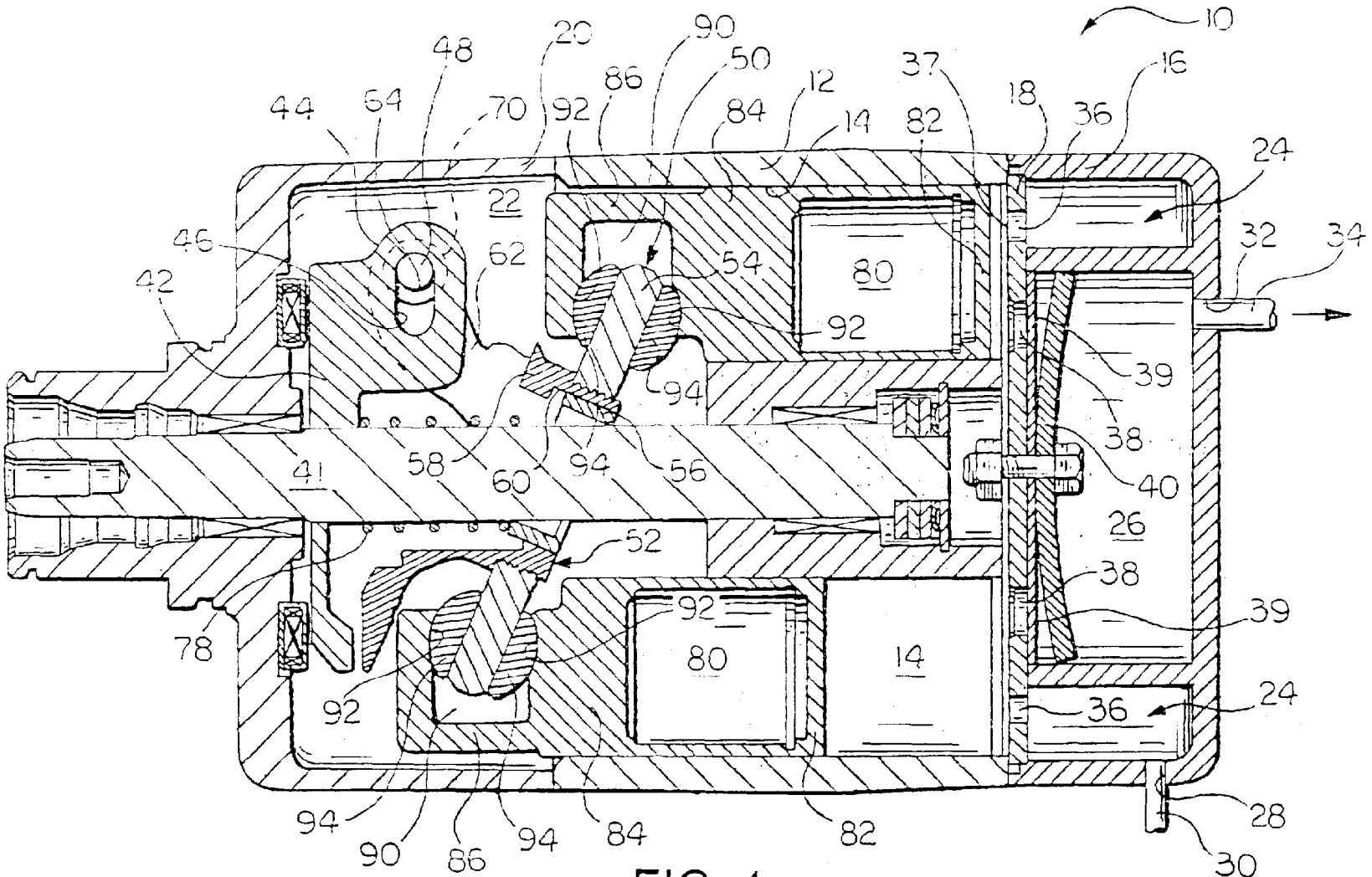
FIG. 1 is a cross sectional elevational view of a variable displacement swash plate type compressor incorporating the features of the invention and showing the smash plate at a maximum inclination.

Referring now to the drawings, and particularly FIG. 1, there is shown generally at 10 a variable displacement swash plate type compressor. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a circumferential suction chamber 24 and a discharge chamber 26. An inlet port 28 and associated inlet conduit 30 provide fluid communication between an evaporator (not shown) and an expansion valve (not shown) of an air conditioning system for a vehicle and the suction chamber 24. An outlet port 32 and associated outlet conduit 34 provide fluid communication between the discharge chamber 26 and a condenser (not shown) of the air conditioning system for the vehicle. Suction ports 36 provide fluid communication between the suction chamber 24 and each cylinder 14. Each suction port 36 is opened and closed by a suction valve 37. Discharge ports 38 provide fluid communication between each cylinder 14 and the discharge chamber 26. Each discharge port 38 is opened and closed by a discharge valve 39. A retainer 40 restricts the opening of the discharge valve 39.

A drive shaft 41 is centrally disposed in and arranged to extend through the crankcase 20 to the cylinder block 12. The drive shaft 41 is rotatably supported in the crankcase 20.

Figure 2:
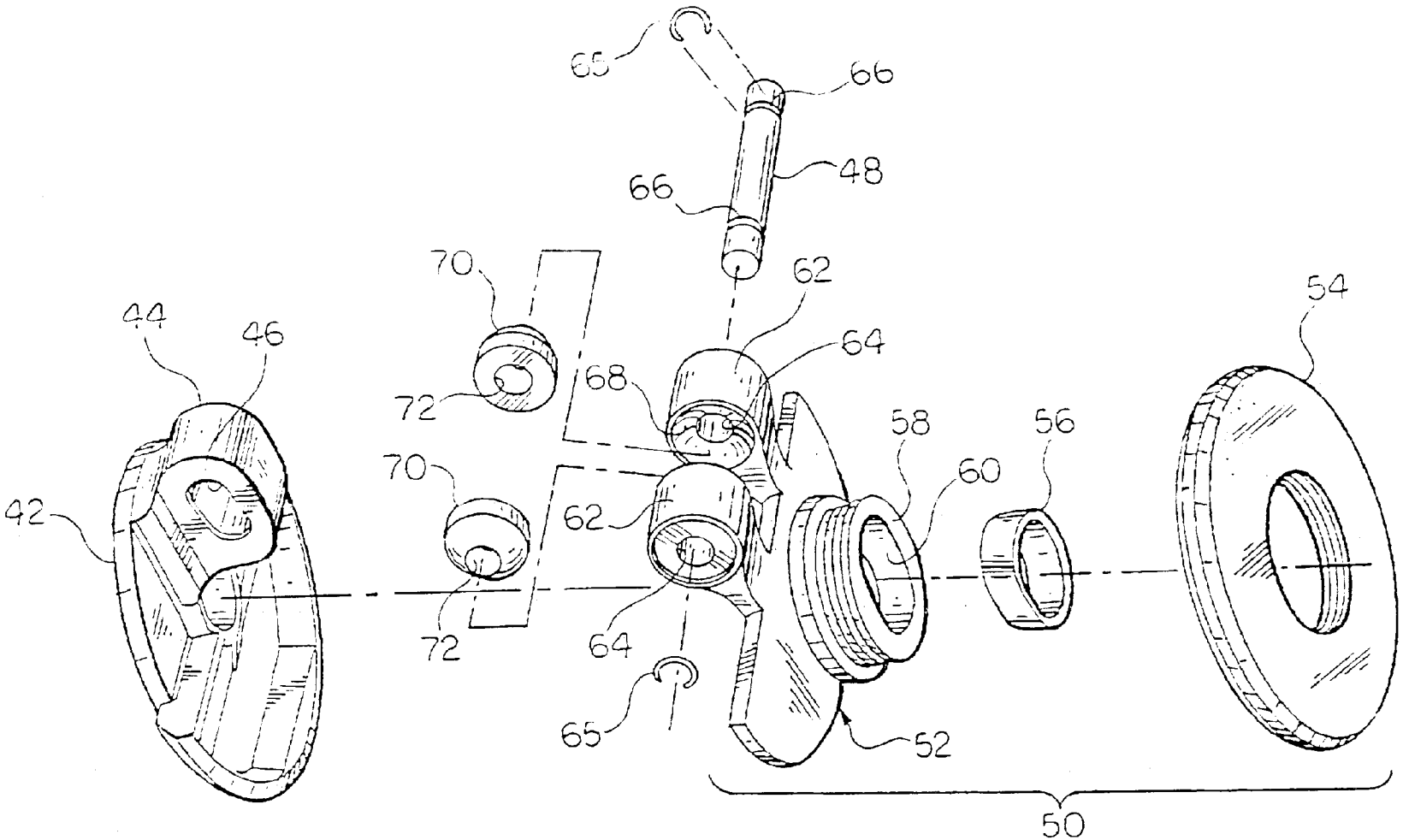
FIG. 2 is an exploded perspective view of a first embodiment of a hinge mechanism of the variable displacement swash plate type compressor illustrated in FIG. 1.

As clearly shown in FIGS. 1 and 2, a rotor 42 is fixedly mounted on an outer surface of the drive shaft 41 adjacent one end of the crankcase 20 within the crank chamber 22. An arm 44 extends outwardly from a surface of the rotor 42 opposite the surface of the rotor 42 that is adjacent the end of the crankcase 20. A slot 46 is formed in the distal end of the arm 44. A pin 48 has a middle portion slidingly disposed in the slot 46 of the arm 44 of the rotor 42.

A swash plate assembly 50 includes a hub 52 and an annular swash plate 54. The swash plate 54 has opposing sides, and a peripheral edge. The hub 52 includes a hollow guide 56, an annular main body 58 with a centrally disposed aperture 60 formed therein, and a pair of arms 62 that extend outwardly from the main body 58 of the hub 52. The drive shaft 41 is adapted to extend through the hollow portion of the guide 56. It is understood that other guide structures such as a cylindrical sleeve or a spherical bushing, for example, can be used in place of the guide 56 without departing from the scope and spirit of the invention. The guide structures may be pinned to the hub 52.

An aperture 64 is formed in the distal end of each of the arms 62 of the hub 52, as clearly shown in FIG. 2. One end of the pin 48 is disposed in the aperture 64 of one of the arms 62 and the other end of the pin 48 is disposed in the aperture 64 of the other arm 62. A clip 65 fits in a slot 66 at each end of the pin 48 to hold the pin 48 in a desired position. A semi-spherical pocket 68 is formed in the inner facing surfaces of each of the arms 62 of the hub 52. One of a pair of shoes 70 having a central aperture 72 is disposed in each of the pockets 68. The pin 48 is received in the aperture 72 of each shoe 70. A portion of an outer surface of the main body 58 is threaded to threadingly engage an inner surface of the swash plate 54.

A helical spring 78 is disposed to extend around the outer surface of the drive shaft 41. One end of the spring 78 abuts the rotor 42, while the opposite end abuts the guide 56.

A piston 80 is slidably disposed in each of the cylinders 14 in the cylinder block 12. Each piston 80 includes a head 82, a middle portion 84, and a bridge portion 86. The middle portion 84 terminates in the bridge portion 86 to define an interior space 90 for receiving the peripheral edge of the swash plate 54. Spaced apart concave pockets 92 are formed in the interior space 90 of the bridge portion 86 for rotatably containing semi-spherical bearing shoes 94. It is understood that the shoes 94 can be of another shape such as spherical, cylindrical, or elliptical, for example.

The operation of the compressor 10 is accomplished by rotation of the drive shaft 41 by an auxiliary drive means (not shown), which may typically be the internal combustion engine of a vehicle. Rotation of the drive shaft 41 causes the rotor 42 to correspondingly rotate with the drive shaft 41.

The swash plate assembly 50 is connected to the rotor 42 by the hinge mechanism formed by the pin 48 slidingly disposed in the slot 46 of the arm 44 of the rotor 42 and disposed in the apertures 64 of the arms 62 of the hub 52. As the rotor 42 rotates, the connection made by the pin 48 and the shoes 70 between the swash plate assembly 50 and the rotor 42 causes the swash plate assembly 50 to rotate. The shoes 70 can rotate within the pockets 68.

Axial loads are transmitted by the pin 48, whereas transverse loads and rotational loads are transmitted by the shoes 70. Since the shoes 70 transmit the transverse loads and rotational loads, the guide 56, which is typically formed of a hardened metal, can be used instead of a guide structure pinned to the hub 52 such as a cylindrical sleeve or a spherical bushing, for example. The shoes 70 militate against a binding of the arms 62 of the hub 52 and the arm 44 of the rotor 42 during rotation and tilting and thus facilitate smooth operation of the hinge mechanism, and ultimately the compressor 10. The shoes 70 also militate against binding when the rotor 42 is not square on the shaft 41, thus facilitating a relaxation of manufacturing tolerances and minimizing manufacturing costs. A desired spacing is maintained between the arms 62 of the hub 52 and the arm 44 of the rotor 42 by the shoes 70. The shoes 70 are typically formed from steel, and the rotor 42 and the hub 52 are typically formed from ductile iron or steel. It is understood that the shoes 70, the rotor 42, and the hub 52 can be formed from other materials as desired, without departing from the scope and spirit of the invention.

During rotation, the swash plate 54 is disposed at an inclination. The rotation of the swash plate 54 is effective to reciprocatively drive the pistons 80. The rotation of the swash plate 54 further causes a sliding and/or rolling engagement between the opposing sides of the swash plate 54 and the cooperating spaced apart shoes 94.

The capacity of the compressor 10 can be changed by changing the inclination of the swash plate 54 and thereby changing the length of the stroke of the pistons 80. A control valve (not shown) is arranged to monitor the suction and discharge pressures of the compressor 10, and control the flow of refrigerant gas from the discharge chamber 26 to the crank chamber 22 through a conduit (not shown). Specifically, when an increase in thermal load occurs, the control valve is caused to close, thereby stopping the flow of refrigerant gas through the control valve to the crank chamber 22. The pressure differential between the crank chamber 22 and the suction chamber 24 is then equalized by bleeding refrigerant gas through an orifice (not shown) to the suction chamber 24. As a result of the decreased backpressure acting on the pistons 80 in the crank chamber 22, the pin 48 is caused to move slidably and outwardly within the slot 46. The swash plate assembly 50 is caused to move against the force of the spring 78, the inclination of the swash plate 54 is increased, and as a result, the length of the stroke of each piston 80 is increased.

Conversely, when a decrease in thermal load occurs, the control valve is caused to open, thereby bleeding refrigerant gas from the discharge chamber 26 to the crank chamber 22 through the conduit. Because the flow of pressurized refrigerant gas to the crank chamber 22 from the discharge 26 is larger than the flow of refrigerant gas from the crank chamber 22, to the suction chamber 24, through the orifice, the backpressure acting on the pistons 80 in the crank chamber 22 is increased. As a result of the increased backpressure in the crank chamber 22, the pin 48 is moved slidably and inwardly within the slot 46. The swash plate assembly 50 yields to the force of the spring 78, the inclination of the swash plate 54 is decreased, and as a result, the length of the stroke of each piston 80 is reduced.

During rotation of the swash plate 54, each piston 80 is caused to move from a top dead center position to a bottom dead center position in respect of each cooperating cylinder 14, thus repetitively drawing in a refrigerant gas, compressing the refrigerant gas, and discharging the refrigerant gas to the air conditioning system of the vehicle.

Additional embodiments of the invention will now be described, wherein parts having already been described retain corresponding reference numerals.

Figure 3:
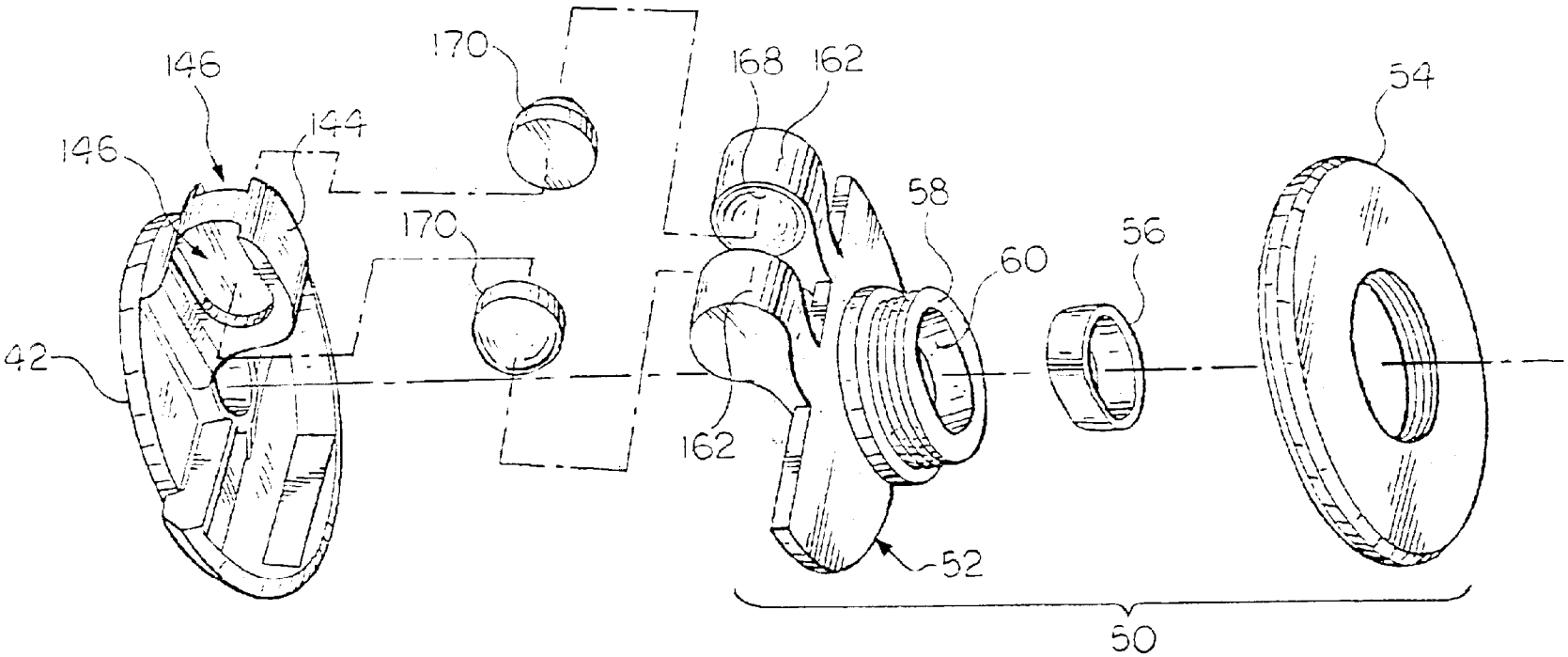
FIG. 3 is an exploded perspective view of a second embodiment of a hinge mechanism of the variable displacement swash plate type compressor illustrated in FIG. 1.

There is shown in FIG. 3 a second embodiment of a hinge mechanism of the variable displacement swash plate type compressor illustrated in FIG. 1.

Referring now to FIGS. 1 and 3, the rotor 42 includes an arm 144 extending outwardly from a surface of the rotor 42 opposite the surface of the rotor 42 that is adjacent the end of the crankcase 20. A pair of slots 146 are formed in opposite sides of the arm 144.

The hub 52 includes a pair of arms 162 that extend outwardly from the main body 58 of the hub 52. A semi-spherical pocket 168 is formed in the inner facing surfaces of each of the arms 162 of the hub 52. One of a pair of shoes 170 is disposed in each of the pockets 168. A flat outer surface of the shoes 170 is slidingly received in a corresponding one of the slots 146 of the arm 144 of the rotor 42.

During operation of the compressor 10, the swash plate assembly 50 is connected to the rotor 42 by the hinge mechanism formed by the slots 146, the shoes 170, and the pockets 168. As the rotor 42 rotates, the connection made by the slots 146, the shoes 170, and the pockets 168 between the swash plate assembly 50 and the rotor 42 causes the swash plate assembly 50 to rotate. The shoes 170 can rotate within the pockets 168. Axial loads, transverse loads, and rotational loads are transmitted by the shoes 170. Since the shoes 170 transmit the axial loads, transverse loads, and rotational loads, the guide 56 formed of a hardened metal can be used instead of a guide structure pinned to the hub 52 such as a cylindrical sleeve or a spherical bushing, for example. The shoes 170 militate against a binding of the arms 162 of the hub 52 and the arm 144 of the rotor 42 during rotation and tilting ard thus facilitate smooth operation of the hinge mechanism, and ultimately the compressor 10. The shoes 170 also militate against binding when the rotor 42 is not square on the drive shaft 41, thus facilitating a relaxation of manufacturing tolerances and minimizing manufacturing costs. A desired spacing is maintained between the arms 162 of the hub 52 and the arm 144 of the rotor 42 by the shoes 170.

The remainder of the structure and operation is the same as described for the first embodiment of the invention.

Figure 4:
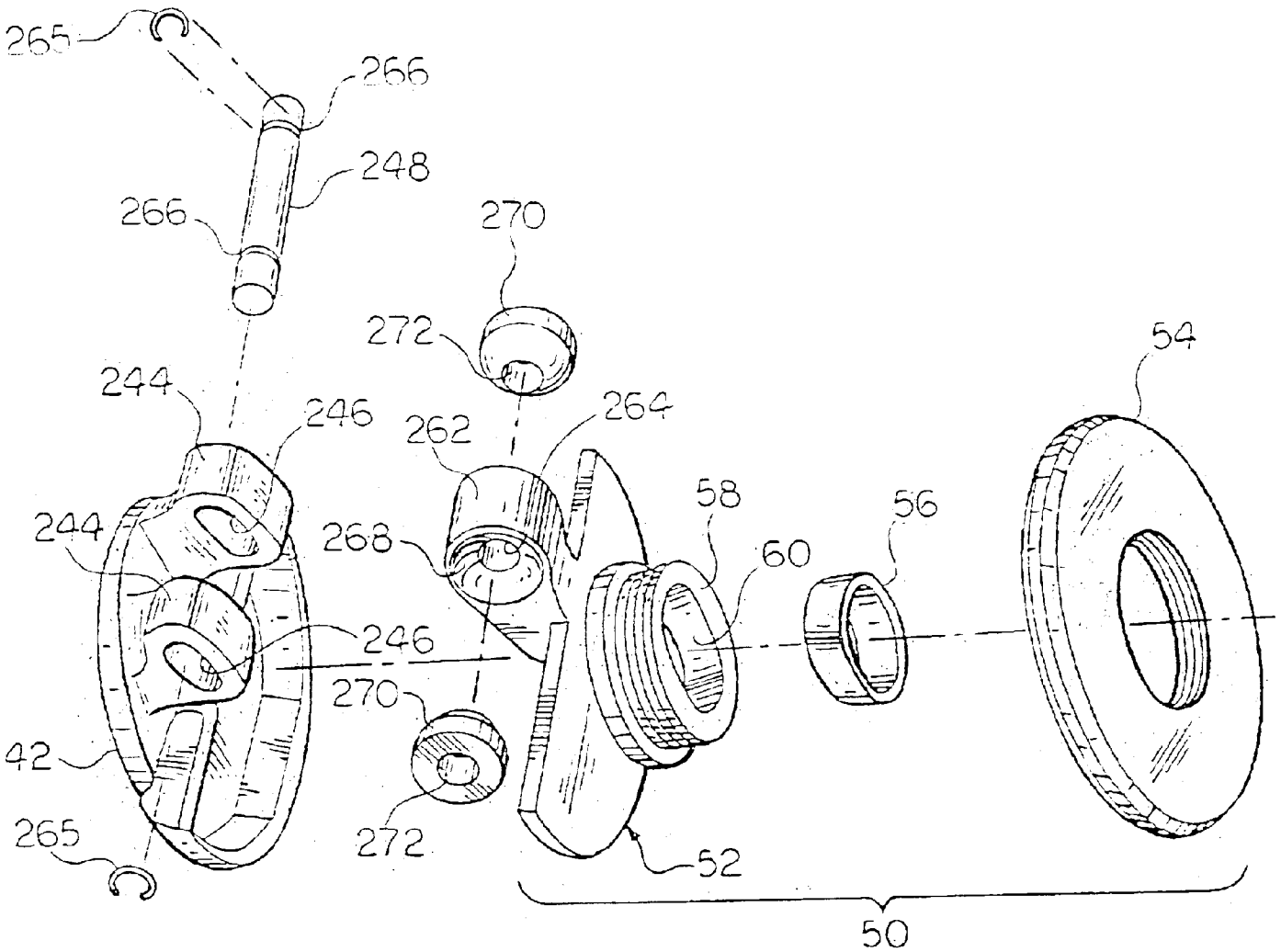
FIG. 4 is an exploded perspective view of a third embodiment of a hinge mechanism of the variable displacement swash plate type compressor illustrated in FIG. 1.

There is shown in FIG. 4 a third embodiment of a hinge mechanism of the variable displacement swash plate type compressor 10 illustrated in FIG. 1.

Referring now to FIGS. 1 and 4, the rotor 42 includes a pair of arms 244 extending outwardly from a surface of the rotor 42 opposite the surface of the rotor 42 that is adjacent the end of the crankcase 20. A slot 246 is formed in each of the arms 244. One end of a pin 248 is disposed in the slot 246 of one of the arms 244 and the other end of the pin 248 is disposed in the slot 246 of the other arm 244.

The hub 52 includes an arm 262 that extends outwardly from the main body 58 of the hub 52. A semi-spherical pocket 268 is formed in each of the outer side surfaces of the arm 262 of the hub 52. An aperture 264 is formed in the distal end of the arm 262 of the hub 52. One of a pair of shoes 270 having a central aperture 272 formed therein is disposed in each of the pockets 268. The arm 262 is placed between the arms 244 of the rotor 42 to align the aperture 264 with the slots 246 of the arms 244. The pin 248 is inserted through the slots 246, the shoes 270, and the aperture 264 such that the middle portion of the pin 248 is disposed in the aperture 264 of the arm 262 of the hub 52. A clip 265 fits in a slot 266 at each end of the pin 248 to hold the pin 248 in a desired position.

During operation of the compressor 10, the swash plate assembly 50 is connected to the rotor 42 by the hinge mechanism formed by the slots 246, the pin 248, the shoes 270, and the pockets 268. As the rotor 42 rotates, the connection made by the slots 246, the pin 248, the shoes 270, ard the pockets 268 between the swash plate assembly 50 and the rotor 42 causes the swash plate assembly 50 to rotate. The shoes 270 can rotate within the pockets 268. Axial loads are transmitted by the pin 248. Transverse loads and rotational loads are transmitted by the shoes 270. Since the shoes 270 transmit the transverse loads and rotational loads, the guide 56 formed of a hardened metal can be used instead of a guide structure pinned to the hub 52 such as a cylindrical sleeve or a spherical bushing, for example. The shoes 270 militate against a binding of the arm 262 of the hub 52 and the arms 244 ok the rotor 42 during rotation and tilting and thus facilitate smooth operation of the hinge mechanism, and ultimately the compressor 10. The shoes 270 also militate against binding when the rotor 42 is not square on the drive shaft 41, thus facilitating a relaxation of manufacturing tolerances and minimizing manufacturing costs. A desired spacing is maintained between the arm 262 of the hub 52 and the arms 244 of the rotor 42 by the shoes 270.

The remainder of the structure and operation is the same as described for the first embodiment of the invention.

Figure 5:
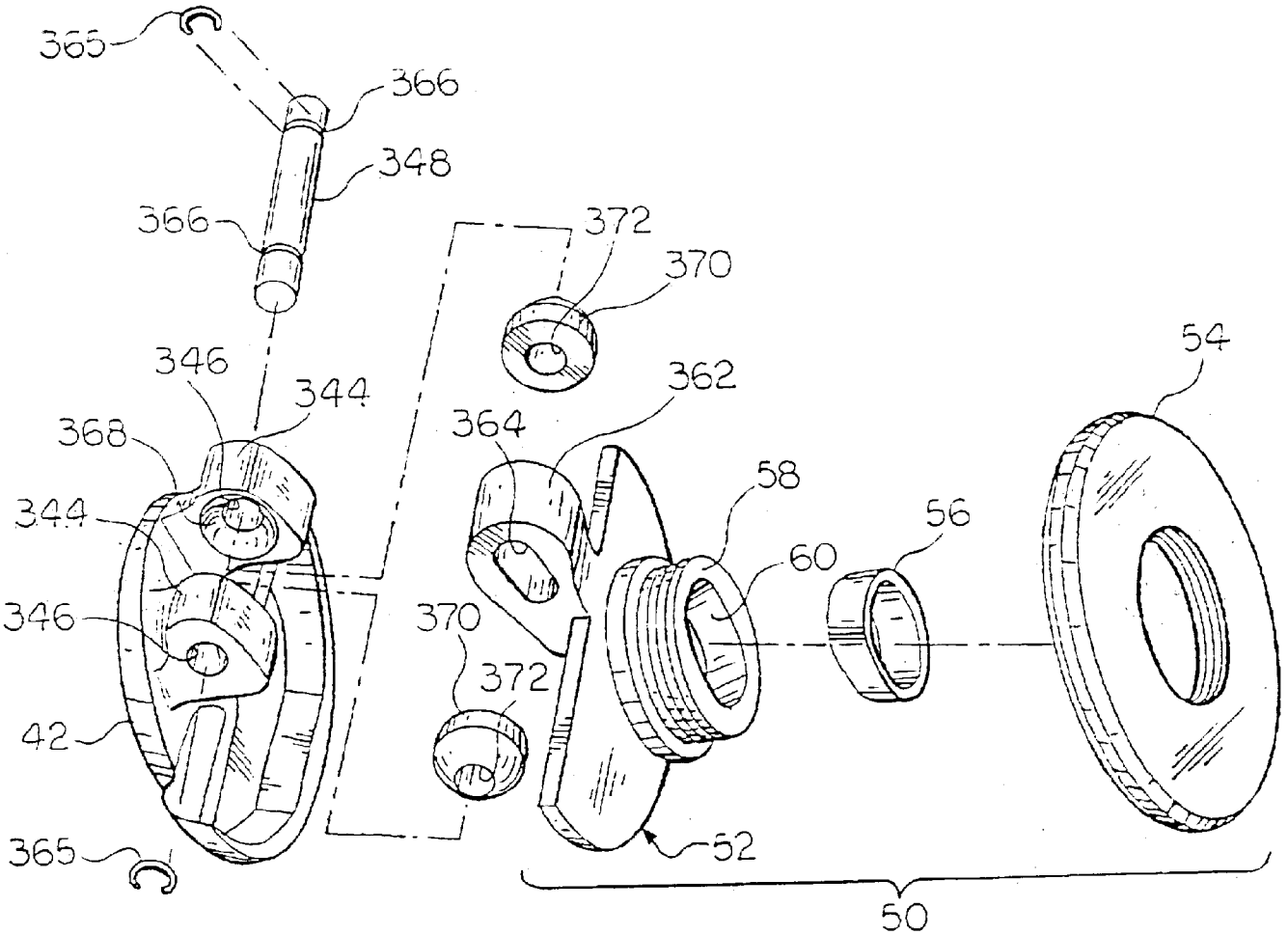
FIG. 5 is an exploded perspective view of a fourth embodiment of a hinge mechanism of the variable displacement swash plate type compressor illustrated in FIG. 1.

There is shown in FIG. 5 a fourth embodiment of a hinge mechanism of the variable displacement swash plate type compressor 10 illustrated in FIG. 1.

Referring now to FIGS. 1 and 5, the rotor 42 includes a pair of arms 344 extending outwardly from a surface of the rotor 42 opposite the surface of the rotor 42 that is adjacent the end of the crankcase 20. An aperture 346 is formed in each of the arms 344. One end of a pin 348 is disposed in the aperture 346 of one of the arms 344 and the other end of the pin 348 is disposed in the aperture 346 of the other arm 344. A semi-spherical pocket 368 is formed in each of the inner facing surfaces of the arms 344 of the rotor 42. One of a pair of shoes 370 having a central aperture 372 formed therein is disposed in each of the pockets 368.

The hub 52 includes an arm 362 that extends outwardly from the main body 58 of the hub 52. A slot 364 is formed in the distal end of the arm 362 of the hub 52. The arm 362 is placed between the arms 344 of the rotor 42 to align the apertures 346 with the slot 364. The pin 348 is inserted through the apertures 346, the shoes 370, and the slot 364 such that the middle portion of the pin 348 is slidingly disposed in the slot 364 of the arm 362 of the hub 52. A clip 365 fits in a slot 366 at each end of the pin 348 to hold the pin 348 in a desired position.

During operation of the compressor 10, the swash plate assembly 50 is connected to the rotor 42 by the hinge mechanism formed by the apertures 346, the pin 348, the shoes 370, the pockets 368, and the slot 364. As the rotor 42 rotates, the connection made by the apertures 346, the pin 348, the shoes 370, the pockets 368, and the slot 364 between the swash plate assembly 50 and the rotor 42 causes the swash plate assembly 50 to rotate. The shoes 370 can rotate within the pockets 368. Axial loads are transmitted by the pin 348. Transverse loads and rotational loads are transmitted by the shoes 370. Since the shoes 370 transmit the transverse loads and rotational loads, the guide 56 formed of a hardened metal can be used instead of a guide structure pinned to the hub 52 such as a cylindrical sleeve or a spherical bushing, for example. The shoes 370 militate against a binding of the arm 362 of the hub 52 and the arms 344 of the rotor 42 during rotation and tilting and thus facilitate smooth operation of the hinge mechanism, and ultimately the compressor 10. The shoes 370 also militate against binding when the rotor 42 is not square on the drive shaft 41, thus facilitating a relaxation of manufacturing tolerances and minimizing manufacturing costs. A desired spacing is maintained between the arm 362 of the hub 52 and the arms 344 of the rotor 42 by the shoes 370.

The remainder of the structure and operation is the same as described for the first embodiment of the invention.

Figure 6:
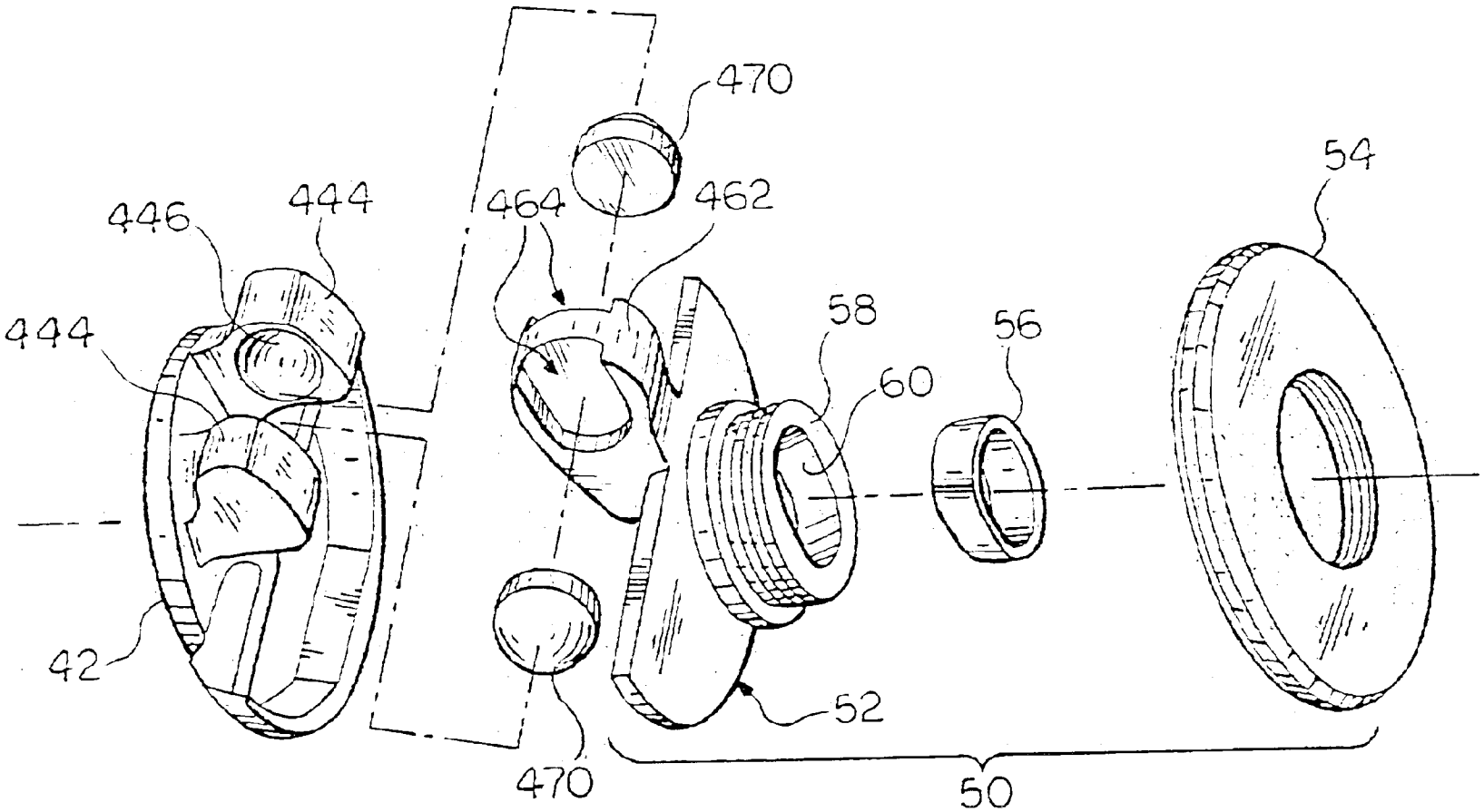
FIG. 6 is an exploded perspective view of a fifth embodiment of a hinge mechanism of the variable displacement swash plate type compressor illustrated in FIG. 1.

There is shown in FIG. 6 a fifth embodiment of a hinge mechanism of the variable displacement swash plate type compressor 10 illustrated in FIG. 1.

Referring now to FIGS. 1 and 6, the rotor 42 includes a pair of arms 444 extending outwardly from a surface of the rotor 42 opposite the surface of the rotor 42 that is adjacent the end of the crankcase 20. A semi-spherical pocket 446 is formed in the inner facing surfaces of each of the arms 444 of the rotor 42.

The hub 52 includes an arm 462 that extends outwardly from the main body 58 of the hub 52. A pair of slots 464 are formed in opposite sides of the arm 462. One of a pair of shoes 470 is disposed in each of the pockets 446 of the arms 444 of the rotor 42. A flat outer surface of the shoes 470 is slidingly received in a corresponding one of the slots 464 of the arm 462 of the hub 52.

During operation of the compressor 10, the swash plate assembly 50 is connected to the rotor 42 by the hinge mechanism formed by the slots 464, the shoes 470, and the pockets 446. As the rotor 42 rotates, the connection made by the slots 464, the shoes 470, and the pockets 446 between the swash plate assembly 50 and the rotor 42 causes the swash plate assembly 50 to rotate. The shoes 470 can rotate within the pockets 446. Axial loads, transverse loads, and rotational loads are transmitted by the shoes 470. Since the shoes 470 transmit the axial loads, transverse loads, and rotational loads, the guide 56 formed of a hardened metal can be used instead of a guide structure pinned to the hub 52 such as a cylindrical sleeve or a spherical bushing, for example. The shoes 470 militate against a binding of the arm 462 of the hub 52 and the arms 444 of the rotor 42 during rotation and tilting and thus facilitate smooth operation of the hinge mechanism, and ultimately the compressor 10. The shoes 470 also militate against binding when the rotor 42 is not square on the drive shaft 41, thus facilitating a relaxation of manufacturing tolerances and minimizing manufacturing costs. A desired spacing is maintained between the arm 462 of the hub 52 and the arms 444 of the rotor 42 by the shoes 470.

The remainder of the structure and operation is the same as described for the first embodiment of the invention.

Figure 7:
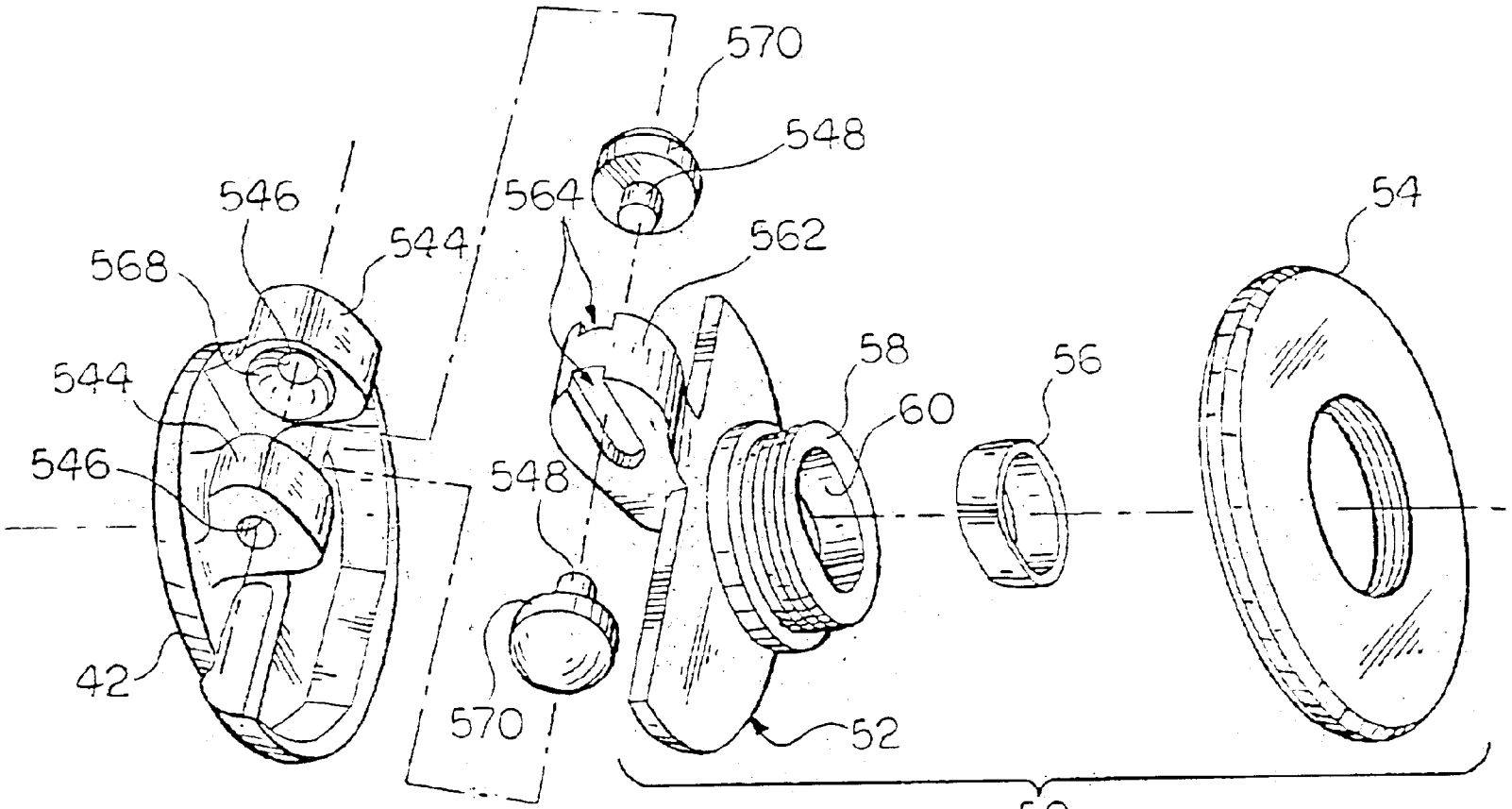
FIG. 7 is an exploded perspective view of a sixth embodiment of a hinge mechanism of the variable displacement swash plate type compressor illustrated in FIG. 1.

There is shown in FIG. 7 a sixth embodiment of a hinge mechanism of the variable displacement swash plate type compressor 10 illustrated in FIG. 1.

Referring now to FIGS. 1 and 7, the rotor 42 includes a pair of arms 544 extending outwardly from a surface of the rotor 42 opposite the surface of the rotor 42 that is adjacent the end of the crankcase 20. An aperture 546 is formed in each of the arms 544. A semi-spherical pocket 568 is formed in each of the inner facing surfaces of the arms 544 of the rotor 42. One of a pair of shoes 570 is disposed in each of the pockets 568. The side of each of the shoes 570 opposite the side disposed in the pockets 568 has a pin 548 extending outwardly therefrom.

The hub 52 includes an arm 562 that extends outwardly from the main body 58 of the hub 52. A pair of slots 564 are formed in opposite sides of the arm 562. A pin 548 is slidingly received in a corresponding one of the slots 564 of the arm 562 of the hub 52.

During operation of the compressor 10, the swash plate assembly 50 is connected to the rotor 42 by the hinge mechanism formed by the shoes 570, the pockets 568, the pins 548, and the slots 564. As the rotor 42 rotates, the connection made by the shoes 570, the pockets 568, the pins 548, and the slots 564 between the swash plate assembly 50 and the rotor 42 causes the swash plate assembly 50 to rotate. The shoes 570 can rotate within the pockets 568. Axial loads are transmitted by the pins 548. Transverse loads and rotational loads are transmitted by the shoes 570. Since the shoes 570 transmit the transverse loads and rotational loads, the guide 56 formed of a hardened metal can be used instead of a guide structure pinned to the hub 52 such as a cylindrical sleeve or a spherical bushing, for example. The shoes 570 militate against a binding of the arm 562 of the hub 52 and the arms 544 of the rotor 42 during rotation and tilting and thus facilitate smooth operation of the hinge mechanism, and ultimately the compressor 10. The shoes 570 also militate against binding when the rotor 42 is not square on the drive shaft 41, thus facilitating a relaxation of manufacturing tolerances and minimizing manufacturing costs. A desired spacing is maintained between the arm 562 of the hub 52 and the arms 544 of the rotor 42 by the shoes 570.

The remainder of the structure and operation is the same as described for the first embodiment of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A hinge mechanism for a variable displacement compressor comprising:

a rotor adapted to be mounted on and rotated by a drive shaft, said rotor having at least one arm extending outwardly therefrom;

a hub adapted to be mounted on the drive shaft and to rotate with said rotor, said hub having at least one arm extending outwardly therefrom towards said rotor and adjacent the arm of said rotor;

at least one shoe disposed between the arm of said rotor and the arm of said hub, said shoe adapted to be seated in a pocket formed in at least one of the arm of said rotor and the arm of said hub, wherein said shoe facilitates a slanting of said hub and transfers rotation from said rotor to said hub; and a pin, wherein an other of the arm of said rotor and the arm of said hub has a slot formed therein to receive said pin, said shoe has a central aperture formed therein, and the at least one of the arm of said rotor and the arm of said hub has an aperture formed therein, said pin adapted to be received in the aperture of the at least one of the arm of said rotor and the arm of said hub, the aperture of said shoe, hinge connection between said rotor and said hub.

2. The hinge mechanism according to claim 1, further comprising a guide disposed between said hub and the drive shaft.

3. The hinge mechanism according to claim 2, wherein said guide is hollow.

4. The hinge mechanism according to claim 1, wherein said shoe has a semi-spherical surface formed on a first side to engage the pocket formed in at least one of the arm of said rotor and the arm of said hub, and said shoe having a flat surface formed on a second side to slidingly engage the other of the arm of said rotor and the arm of said hub.

5. The hinge mechanism according to claim 1, wherein an other of the arm of said rotor and the arm of said hub has at least one slot formed therein to slidingly receive said shoe.

6. A variable displacement swash plate type compressor comprising:

a cylinder block having a plurality of cylinders arranged radially therein;

a plurality of pistons, one of said pistons reciprocatively disposed in each of the cylinders of said cylinder block;

a cylinder head attached to said cylinder block;

a crankcase attached to said cylinder block and cooperating with said cylinder block to define a crank chamber;

a drive shaft rotatably supported by said crankcase and said cylinder block in the crank chamber;

a rotor mounted on said drive shaft;

a swash plate assembly slidably mounted on said drive shaft to thereby change an inclination angle thereof in response to changes of pressure in the crank chamber, said swash plate assembly operatively engaged with said pistons to reciprocatively drive said pistons;

a hinge mechanism disposed between said rotor and said swash plate assembly for changing the inclination angle of said swash plate assembly, wherein said hinge mechanism further comprises:

at least one arm extending outwardly from said rotor towards said swash plate assembly;

at least one arm extending outwardly from said swash plate assembly towards said rotor and adjacent said arm of said rotor;

at least one shoe disposed between said arm of said rotor and said arm of said swash plate assembly, said shoe adapted to be seated in a pocket formed in at least one of said arm of said rotor and said arm of said swash plate assembly, wherein said shoe facilitates inclination of said swash plate assembly and transfers rotation from said rotor to said swash plate assembly; and a pin, wherein an other of said arm of said rotor and said arm of said swash plate assembly has a slot formed therein to receive said pin, said shoe has a central aperture formed therein, and the at least one of said arm of said rotor and said arm of said swash plate assembly has an aperture formed therein, said pin adapted to be received in the aperture of the at least one of said arm of said rotor ard said arm of said hub, the aperture of said shoe, and the slot of the other of said arm of said rotor and said arm of said swash plate assembly.

7. The compressor according to claim 6, further comprising a guide disposed between said swash plate assembly and said drive shaft.

8. The compressor according to claim 7, wherein said guide is hollow.

9. The compressor according to claim 6, wherein said shoe has a semi-spherical surface formed on a first side to engage the pocket formed in at least one of said arm of said rotor and said arm of said swash plate assembly, and said shoe having a flat surface formed on a second side to slidingly engage the other of said arm of said rotor and said arm of said swash plate assembly.

10. The compressor according to claim 6, wherein an other of said arm of said rotor and said arm of said swash plate assembly has at least one slot formed therein to slidingly engage said shoe.

11. A hinge mechanism for a variable displacement compressor comprising:

a rotor adapted to be mounted on and rotated by a drive shaft;

a hub adapted to be slidably mounted on the drive shaft to thereby change an inclination angle thereof and to rotate with said rotor, wherein at least one of said rotor and said hub has a first arm extending outwardly therefrom, and the other of said rotor and said hub has a pair of second arms extending outwardly therefrom, and wherein at least one of the first arm and the pair of second arms has a pair of pockets formed therein;

a pair of shoes, each adapted to be seated in a respective one of the pair of pockets, wherein said shoes facilitate a slanting of said hub and transfer rotation from said rotor to said hub; and a pin, wherein an other of the first arm and the second arms include a slot formed therein to receive said pin, each of said shoes having a central a aperture formed therein, and the at least one of the first arm and the second arms include an aperture formed therein, said pin adapted to be received in the aperture of the at least one of the first arm and the second arms, the aperture of each of said shoes, and the slot of the other of the first arm and the second arm to form a hinge connection between said rotor and said hub.

12. The hinge mechanism according to claim 11, further comprising a guide disposed between said hub and the drive shaft.

13. The hinge mechanism according to claim 11, wherein said shoes have a semi-spherical surface formed on a first side to engage the pocket formed in at least one of the first arm and the second arms, and said shoes having a flat surface formed on a second side to slidingly engage the other of the first arm and the second arms.

14. The hinge mechanism according to claim 11, wherein an other of the first arm and the second arms include at least one slot formed therein to sildingly engage said shoes.

* * * * *